United States Patent [19]

Murai et al.

[11] 4,193,764

[45] Mar. 18, 1980

[54] FAT-LIQUORING COMPOSITIONS FOR LEATHER

[75] Inventors: Yoshikazu Murai; Okitsugu Tsuji; Atsushi Sato, all of Yokohama, Japan

[73] Assignee: Nippon Petrochemicals Co., Ltd., Tokyo, Japan

[21] Appl. No.: 902,958

[22] Filed: May 4, 1978

[30] Foreign Application Priority Data

May 10, 1977 [JP] Japan ..... 52-52652

[51] Int. Cl.[2] ..... C14C 5/00; C14C 11/00

[52] U.S. Cl. ..... 8/94.22; 8/94.23

[58] Field of Search ..... 8/94.23, 94.22

[56] References Cited

U.S. PATENT DOCUMENTS 3,291,557 12/1966 Neher et al. ..... 8/94.22

3,811,832 5/1974 Briggs ..... 8/94.22

FOREIGN PATENT DOCUMENTS 48-8901 2/1973 Japan .

*Primary Examiner*—A. Lionel Clingman

*Attorney, Agent, or Firm*—Ostrolenk, Faber, Gerb & Soffen

[57] ABSTRACT

An excellent fat-liquoring composition for leather comprises 100 parts by weight of a neutralized polybutene sulfonation product, 1–100 parts by weight of a polybutene and 1–100 parts by weight of one or more fatty acid salts. The polybutene employed herein has a number average molecular weight of 250–1500, is normally in a liquid form, and is obtained by polymerizing a mixed $C_4$ fraction in the presence of a Friedel-Crafts type catalyst. The polybutene thus prepared is sulfonated with sulfur trioxide or chlorosulfonic acid with or without a diluent such as air, nitrogen, carbon dioxide or sulfur dioxide and liquid solvents, etc. to obtain a polybutene sulfonation product. The polybutene sulfonation product is neutralized with an aqueous solution of alkali metal hydroxides or ammonia to prepare neutralized polybutene sulfonation products. As fatty acid salt or salts, alkenylsuccinic acid salts having 12–28 carbon atoms, stearic acid salts, oleic acid salts, cetoleic acid salts, wool wax acid salts and others are effectively used. All these fatty acid salts have 12–28 carbon atoms.

12 Claims, No Drawings

FAT-LIQUORING COMPOSITIONS FOR LEATHER

BACKGROUND OF THE INVENTION

This invention relates to a polybutene composition used for a fat-liquoring substance or agent, more particularly to a fat-liquoring composition for leather containing a neutralized polybutene sulfonation product, a polybutene and fatty acid salt or salts.

Heretofore, natural oils have been used as a fat-liquoring substance for leather. For example, marine oils such as cod oil, shark oil, sperm oil and their sulfation and sulfornation oils, and land oils such as neat's foot oil, wool wax and their sulfation and sulfonation oils have been employed alone or as a mixture thereof. Further, as vegetable oils, olive oil, rapeseed oil and their sulfation and sulfonation oils also have been used alone or as a mixture thereof. However, these fat-liquoring substances prevailing in natural oil ingredients are unstable in qualities owing to the occurrence in liquored leather of malodor, yellowing and spew, etc. Further, there was a shortage of raw materials therefor resulting from the exhaustion of natural resources. Thus, the development of production means of fat-liquoring substances principally comprising petrochemical derivatives (referred to as synthetic oil(s) hereinunder) has been promoted recently. For example, in Japanese Patent Bulletin No. 51-44161 (Japanese Patent Publication 51(1976)-44161), a fat-liquoring composition comprising 100 parts by weight of a polybutene, 5–100 parts by weight of a neutralized polybutene sulfonation product and a non-ionic surface active agent respectively added is disclosed.

However, such a fat-liquoring agent mainly comprised of synthetic oils has the following disadvantages, and a satisfactory fat-liquoring substance having a major content of synthetic oils has not yet been found.

That is to say, a fat-liquoring substance containing neutralized polybutene sulfonation products has such defects that when the neutralized polybutene sulfonation product is employed without hydrolysis, a finishing product of stable quality cannot be obtained because the finished product becomes gradually acidic to promote the decomposition of the neutralized product, and because the emulsion of the finished product is demulsified. This is deemed to be due to the decomposition of alkane-sultone compounds included in the neutralized polybutene sulfonation product. In order to eliminate the above defects by previously decomposing the alkane-sultones, the neutralized polybutene sulfonation product may be hydrolyzed, however, in this case, hydroxyalkanesulfonates which are very difficult to dissolve in water are formed. Accordingly, the hydrolyzed products of neutralized polybutene sulfonation products alone are not satisfactory for preparing an excellent and stable emulsion suitable for a fat-liquoring agent. For the reason, in order to obtain an excellent emulsion therefor, the addition of non-ionic surfactants becomes indispensable, as seen in Japanese Patent Bulletin No. 51-44161.

Nevertheless, a fat-liquoring substance obtained by the addition of non-ionic surfactants has such fatal disadvantages that the commercial value is low because the feel of leather treated therewith is hard and the handling thereof is very inferior in comparison with that of leather treated and finished with a fat-liquoring substance comprising natural oils as a raw material. This results from a large absorption of the surfactant in the leather and absorption thereby in the leather of a greater part of neutral oils included in the fat-liquoring substance.

In such circumstances, many attempts have been made in the field concerned heretofore in order to develop an improved fat-liquoring substance without various disadvantages described above, however such attempts have not been crowned with success until now.

BRIEF SUMMARY OF THE INVENTION

Earnest efforts have been made by the inventors in order to develop an excellent fat-liquoring substance not having such disadvantages described above which comprises a major portion of synthetic oils. As a result, it has been found that a stable and excellent emulsion suitable for fat-liquoring of leather is obtained by adding a polybutene and a salt of fatty acid to a neutralized polybutene sulfonation product, and that the composition thus prepared is appropriate as a major component of a fat-liquoring substance for leather which shows very superior fat-liquoring effects. This invention has been attained on the basis of the above fact and knowledge.

An object of this invention is to provide an excellent fat-liquoring composition for leather comprising 100 parts by weight of a neutralized polybutene sulfonation product and 1–100 parts by weight of a polybutene and 1–100 parts by weight of fatty acid salt or salts.

Another object of this invention is to provide an excellent fat-liquoring composition for leather that does not cause the leather to yellow, to emit an offensive odor and to spew.

A further object of this invention is to provide a leather having superior feel and handling by treating it with the fat-liquoring agent thus obtained.

Other objects will be self-evident if one reads the explanation stated hereinunder.

DETAILED DESCRIPTION OF THE INVENTION

This invention will be now described more in detail hereinunder.

This invention is concerned with a fat-liquoring composition for leather including a major portion of a neutralized polybutene sulfonation product, a polybutene and fatty acid salt or salts. The polybutene employed in this invention is a copolymer of iso-butene and n-butenes prevailing in an amount of iso-butene and is a liquid copolymer having a number average molecular weight of 250–1500 that is prepared by polymerizing a mixed $C_4$ fraction containing 5–45% by weight of iso-butene and 15–40% by weight of n-butenes with essentially negligible amounts of butadienes and acetylenes in the presence of a Friedel-Crafts type catalyst such as $AlCl_3$ and $BF_3$ at reaction temperatures of $-70°-+50°$ C.

Liquid or gaseous sulfur trioxide or chlorosulfonic acid is employed for the sulfonation of the polybutene. These sulfonation agents may be also used in conjunction with a diluent such as air, nitrogen, carbon dioxide, sulfur dioxide and liquid solvents.

The sulfonation reaction is influenced by the ratio of sulfur trioxide to polybutene and dilution ratio of sulfur trioxide. The ratio of sulfur trioxide/diluent is within the range of 0.5–20% by volume, preferably 2–8% by volume, and the ratio of sulfur trioxide/polybutene is within the range of 2–30% by weight, preferably of 5–15% by weight. The reaction temperature is normally within the range of 0°–100° C. The reaction vessel or reactor is of an autoclave type or of a falling thin film reactor type, and the reaction may be carried out batchwise or continuously. In order to obtain desirable sulfonation products for this invention, a continuous falling thin film type reactor is preferably used.

By sulfonating the polybutene with sulfur trioxide in the manner described above, the reaction product comprising alkenyl sulfonic acids, alkane-sultones and mineral oil ingredients is obtained. Such a product is herein referred to as polybutene sulfonation product(s).

The above polybutene sulfonation product is made into respective salts thereof by neutralizing with an aqueous solution of an alkali metal hydroxide such as sodium hydroxide, potassium hydroxide, alkaline earth metal hydroxides, ammonia and organic amines, etc.

By neutralizing in this manner, the alkenyl sulfonic acids are made into the corresponding salts, while the alkanesultones and mineral oil ingredients remain as they were. The neutralized polybutene sulfonation product employed in this invention is obtained by the neutralization of the polybutene sulfonation product stated above, and the composition is varied depending upon the reaction conditions of sulfonation and neutralization of polybutene. Preferable mixtures are those comprising 10–25% by weight of alkene sulfonates, 2–12% by weight of alkane-sultones, 15–70% by weight of mineral oil components, 10–40% by weight of water and 0.5–5.0% by weight of inorganic substances. The fatty acid salt or salts employed in this invention are one or more salts selected from alkali metal salts, alkaline earth metal salts, ammonium salts and organic amines of the various organic acids exemplified below: straight chain monobasic fatty acids such as formic acid, capric acid, lauric acid and palmitic acid, unsaturated monobasic fatty acids such as tsuzuic acid (4-tetradecenoic acid), myristoleic acid (9-tetradecanoic acid), oleic acid and cetoleic acid, multi-unsaturated fatty acids such as linoleic acid, linolenic acid, oxy-fatty acids such as oxyhexadecanoic acid, oxy-octadecanoic acid and dibasic fatty acids such as oxalic acid, sebacic acid, hexadecanedicarboxylic acid and alkenylsuccinic acid and a mixture of more than two fatty acids such as wool wax acid, etc. In effecting this invention, fatty acid salts having 12–28 carbon atoms are especially preferable in the respect that these salts are superior in the compatibility with the neutralized polybutene sulfonation product and have a great stabilizing effect for emulsion.

The composition according to this invention is prepared by adding 1–100 parts by weight of a polybutene, preferably 20–80 parts by weight, more preferably 20–50 parts by weight and 1–100 parts by weight of fatty acid salt or salts, preferably 5–80 parts by weight, more preferably 5–40 parts by weight to 100 parts by weight of a neutralized polybutene sulfonation products. When the amount of polybutene added is more than 100 parts by weight, an excellent emulsion cannot be obtained and the emulsion obtained is useless for a fat-liquoring substance. When it is less than 1 part by weight, the fat-liquoring effect is reduced. Further, when the quantity of fatty acid salt or salts added is less than 1 part by weight, it is ineffective for the stability of emulsion. When it is more than 100 parts by weight, the stability of emulsion is hardly improved, and use of such amounts becomes economically disadvantageous. Further, if such an emulsion is employed as a fat-liquoring agent, the fat-liquoring effect for leather is decreased. The fat-liquoring composition according to this invention forms an excellent and stable emulsified product capable of long term storage because the decomposition of alkene sulfonates is prevented due to the lowering of pH.

The fat-liquoring composition of this invention can be employed alone or in combination with natural oils and/or sulfation oils thereof and/or mineral oils normally used, as a fat-liquoring substance.

When the composition of this invention is practically used for fat-liquoring of leather, it is employed in the form of a solubilized emulsion by normally diluting it 2–10 times with water.

When fat-liquoring of leather is performed in this manner using the composition of this invention, the fat-liquoring agent is well absorbed in the leather, and a finished leather having an excellent handling, agreeable feel, a large mechanical strength and good weather-resistance is obtained.

This invention will be further explained in a concrete way hereinunder by way of some examples and comparative examples, although it is not intended to limit the scope of this invention thereto.

EXAMPLE 1

A mixed $C_4$ fraction containing 30% by weight of isobutene and 30% by weight of n-butenes with essentially negligible quantities of butadienes and acetylenes was polymerized in the presence of $AlCl_3$ catalyst at 10° C. The polybutene thus prepared had a number average molecular weight of 300.

The polybutene of 300 g was put into a three-necked flask of one liter capacity with a thermometer and stirrer. To carry out the sulfonation, the polybutene was vigorously stirred, and sulfur trioxide diluted with air (sulfur trioxide/air ratio, 3% by volume) was blown into the flask at a flow velocity of 5 lit./min. for 2.0 hours at a temperature of about 40° C. After the completion of reaction, the blownish polybutene sulfonation product was neutralized by gradually dripping into 100 g of a 10% sodium hydroxide aqueous solution. A yellowish-brown and pasty neutralized polybutene sulfonation product was obtained. A fat-liquoring substance was prepared by using the neutralized polybutene sulfonation product in the following formulation:

| | |
|---|---|
| Neutralized polybutene sulfonation product | 50 parts by weight |
| Polybutene (number average mol.wt., 300) | 20 parts by weight |
| Sodium laurate | 10 parts by weight |
| Water | 20 parts by weight |

The fat-liquoring substance thus prepared had a pH of 7.5, and the pH value after three months was 7.0 without noticeable change, and a change of appearance was also not observed.

The fat-liquoring substance above was diluted 5 times with water. A chrome-tanned clothing cow leather was fat-liquored in a rotating drum with the diluted fat-liquoring agent and was finished by drying in the known method. After fat-liquoring no fat-liquoring, agent remained in the rotating drum. The finished leather thus obtained had a good handling and feel.

Comparative Example 1

A fat-liquoring substance was prepared in the following formulation using the neutralized polybutene sulfonation product obtained in Example 1:

| | |
|---|---|
| Neutralized polybutene sulfonation product | 55 parts by weight |
| Polybutene (number average mol. wt., 300) | 22 parts by weight |
| Water | 23 parts by weight |

When the fat-liquoring substance was prepared, it had a pH of 7.0 and was in a good emulsion. However, after one month the pH was remarkably lowered to 2.6 and the emulsion had broken to realize a phase separation or non-homogeneousness. A clothing leather was fat-liquored in the same way as in Example 1 with use of the fat-liquoring substance. However, due to the demulsification described above, the fat-liquoring substance was not fully absorbed in the leather and remained in the rotating drum. The finished leather was hard to the touch and lacked handling. Further, it was also unbearable for use.

EXAMPLE 2

A mixed $C_4$ fraction including 40% by weight of iso-butene and 20% by weight of n-butenes was polymerized in the presence of $AlCl_3$ catalyst respectively at 0° C. and 10° C.

The obtained polybutene had a number average molecular weight of 500 and 800 respectively.

Four hundred grams of the polybutene having a number average molecular weight of 500 was taken into a three-necked flask of one liter capacity with a thermometer and stirrer. To carry out the sulfonation, under vigorous stirring, sulfur trioxide diluted with air (sulfur trioxide/air ratio, 6% by volume) was introduced with blowing into the flask at a flow velocity of 3 lit./min. for 3 hours at a temperature of about 60° C. The brownish polybutene sulfonation product obtained was neutralized by gradually trickling into 130 g of a 10% aqueous solution of ammonia. A yellowish-brown and pasty neutralized polybutene sulfonation product was obtained.

The above neutralized polybutene sulfonation product was combined with other components in the following formulation to prepare a fat-liquoring substance in the form of a good emulsion:

| | |
|---|---|
| Neutralized polybetene sulfonation product | 50 parts by weight |
| Polybutene (number average mol. wt., 800) | 20 parts by weight |
| Sodium alkenyl ($C_{20}$—$C_{28}$) succinate | 10 parts by weight |
| Water | 20 parts by weight |

The pH of the above fat-liquoring agent when it was prepared was 8.0, and was 7.5 after 3 months without any change of appearance.

A chrome-tanned cow leather for bags and pouches treated in usual manners was fat-liquored in a rotating drum with use of the fat-liquoring agent formed by diluting the above fat-liquoring agent 5 times with water and was finished by drying in the known method. A excellent leather having a good handling and feel was obtained. Further, after fat-liquoring, no fat-liquoring agent remained in the rotating drum and absorption thereof in the leather was satisfactory.

Comparative Example 2

The neutralized polybutene sulfonation product obtained in Example 2 was hydrolyzed at 120° C. under refluxing for 5 hours, and the hydrolyzed product was neutralized with a 10% aqueous solution of ammonia. The neutralized product obtained thus was formulated and combined as follows:

| | |
|---|---|
| Hydrolyzed product of neutralized polybutene sulfonation product | 55 parts by weight |
| Polybutene (number average mol. wt., 800) | 20 parts by weight |
| Sodium alkenyl($C_{20}$—$C_{28}$)succinate | 10 parts by weight |
| Water | 15 parts by weight |

However, a phase separation occurred in the formulated and combined product as above, and an excellent emulsion could not be obtained. Accordingly, it was useless at a fat-liquoring substance.

EXAMPLE 3

A mixed $C_4$ fraction containing 30% by weight of isobutene and 20% by weight of n-butenes was polymerized in the presence of $AlCl_3$ catalyst at 0° C. The obtained polybutene had a number average molecular weight of 470.

The neutralized polybutene sulfonation product obtained in Example 2 and the polybutene thus obtained were formulated in the following proportions to prepare a fat-liquoring substance in good emulsification:

| | |
|---|---|
| Neutralized polybutene sulfonation product | 60 parts by weight |
| Polybutene (number average mol. wt., 470) | 15 parts by weight |
| Ammonium oleate | 5 parts by weight |
| Water | 20 parts by weight |

The pH of the above fat-liquoring substance when prepared was 7.5 and was 7.0 after 2 months. The emulsion formed was stable and homogeneous, and no phase separation occurred. A chrome-tanned clothing leather was fat-liquored in a rotating drum with the above fat-liquoring substance which was diluted with water by 4 times. After that, it was dried to finish by the usual method. The leather finished was soft and of good handling.

Comparative Example 3

The neutralized polybutene sulfonation product obtained in Example 2 and the polybutene obtained in Example 3 were formulated in the following proportions to obtain a fat-liquoring substance:

| | |
|---|---|
| Neutralized polybutene sulfonation product | 100 parts by weight |
| Polybutene (number average mol. wt., 470) | 50 parts by weight |
| Softanol-50 | 10 parts by weight |
| Water | 50 parts by weight |

In this formulation, no fatty acid was employed, and instead of it, a non-ionic surface active agent Softanol-50 (Trade Name of surfactant made by Nippon Shokubai Kagaku Kogyo Co., Ltd., 5 molar ethoxylate of straight chain secondary alcohol of $C_{12}$–$C_{24}$) was used.

A finished leather, which was fat-liquored with the fat-liquoring substance above under the same conditions as those in Example 3, was compared with the leather obtained in Example 3. In mechanical strength such as tensile strength and tear strength, the leather of Comparative Example 3 was inferior to that of Example 3. The surface of the leather was hard, and handling and feel, which are important to clothing leather, were also inferior to those of the leather of Example 3.

EXAMPLE 4

The polybutene obtained in Example 1 was continuously sulfonated with use of a falling thin film reactor of inside diameter 25 mm and of 2 m long provided with cooling jackets under the following reaction conditions:

| | |
|---|---|
| Feed amount of polybutene | 20 kg/hr |
| Feed amount of $SO_3$ | 2.2 kg/hr |
| Feed amount of air | 10 $Nm^3$/hr |
| Temperature of cooling water | 60° C. |

The polybutene sulfonation product thus prepared was neutralized with 15% aqueous sodium hydroxide solution by dripping it gradually in the aqueous alkaline solution, and a yellowish-brown and pasty neutralized polybutene sulfonation product was obtained. A mixed $C_4$ fraction containing 40% by weight of isobutene and 20% by weight of n-butenes was polymerized in the presence of $AlCl_3$ catalyst at −10° C. The polybutene thus obtained had a number average molecular weight of 1000.

A formulation of fat-liquoring substance was made with use of the neutralized polybutene sulfonation product and the polybutene thus obtained in the following proportions, and a fat-liquoring substance was obtained in good emulsification:

| | |
|---|---|
| Neutralized polybutene sulfonation product | 45 parts by weight |
| Polybutene (number average mol. wt., 1000) | 15 parts by weight |
| Sodium alkenyl($C_{20}$—$C_{28}$)succinate | 5 parts by weight |
| Wool wax | 5 parts by weight |
| Water | 30 parts by weight |

The pH of the above fat-liquoring substance when prepared was 8.0 and changed to 7.5 after two months, however, no change was observed in the emulsion.

With use of the fat-liquoring agent prepared by diluting the above fat-liquoring substance 5 times with water, a chrome-tanned cow leather for gloves was fat-liquored in a rotating drum. After fat-liquoring, it was dried and finished in the usual way. The finished leather obtained was of good handling and pliability.

EXAMPLE 5

The neutralized polybutene sulfonation product obtained in Example 4 and the polybutene obtained in Example 1 were formulated in the following proportions to prepare a good emulsified fat-liquoring substance:

| | |
|---|---|
| Neutralized polybutene sulfonation product | 40 parts by weight |
| Polybutene (number average mol. wt., 300) | 16 parts by weight |
| Sodium salt of wool wax acid | 3 parts by weight |
| Sulfated cod oil | 5 parts by weight |
| Water | 36 parts by weight |

The pH of the above fat-liquoring substance when prepared was 8.0 and was 7.0 after 3 months. Separation of phases was not observed in the emulsion, and it remained stable.

The above fat-liquoring substance was diluted 5 times water. With use of the fat-liquoring substance thus diluted, a chrome-tanned suede clothing leather was fat-liquored in a rotating drum. After fat-liquoring, it was dried and finished in the usual way. The leather thus finished was pliable and agreeable to the touch.

What is claimed is:

1. A fat-liquoring composition for leather comprising 100 parts by weight of a non-prehydrolyzed neutralized polybutene sulfonation product, 1–100 parts by weight of a polybutene and 1–100 parts by weight of at least one fatty acid salt.

2. A fat-liquoring composition for leather according to claim 1, wherein said fatty acid salt has 12–28 carbon atoms.

3. A fat-liquoring composition for leather according to claim 1, wherein said fatty acid salt is selected from the group consisting of alkenylsuccinic acid salts having 12–28 carbon atoms, stearic acid salts, oleic acid salts, cetolic acid salts and wool wax acid salts.

4. A fat-liquoring composition for leather according to claim 1, wherein said polybutene is a normally liquid copolymer of isobutene and n-butenes.

5. A fat-liquoring composition for leather according to claim 4, wherein said polybutene has a number average molecular weight of 250–1500.

6. A fat-liquoring composition for leather according to claim 5, wherein the amount of said polybutene is 20–80 parts and the amount of said fatty acid salt is 5–80 parts.

7. A fat-liquoring composition for leather according to claim 6, wherein the amount of said polybutene is 20–50 parts and the amount of said fatty acid salt is 5–40 parts.

8. A fat-liquoring composition for leather comprising an aqueous emulsion of said composition according to claim 1.

9. A fat-liquoring composition for leather according to claim 1, wherein said sulfonation product is an ammonia neutralized sulfonated 500 molecular weight polybutene, said polybutene has a molecular weight of 800 and said fatty acid salt is sodium alkenyl succinate.

10. A fat-liquoring composition for leather according to claim 1, wherein said sulfonation product is an ammonia neutralized sulfonated 470 molecular weight polybutene, said polybutene has a molecular weight of 470 and said fatty acid salt is aluminum oleate.

11. A fat-liquoring composition for leather according to claim 1, wherein said sulfonation product is a sodium hydroxide neutralized sulfonated 300 molecular weight polybuten, said polybutene has a molecular weight of 1000 and said fatty acid is sodium alkenyl succinate.

12. A fat-liquoring composition for leather according to claim 1, wherein said sulfonation product is a sodium hydroxide neutralized sulfonated 300 molecular weight polybutene, said polybutene has a molecular weight of 300 and said fatty acid salt is the sodium salt of wool wax acid.

* * * * *